United States Patent [19]

Matsushima et al.

[11] Patent Number: 4,986,159

[45] Date of Patent: Jan. 22, 1991

[54] ELECTRONIC MUSICAL INSTRUMENT WITH DATA OVERFLOW DETECTOR AND LEVEL LIMITED DATA SELECTION CIRCUIT

[75] Inventors: Tadashi Matsushima; Tsutomu Saito, both of Shizuoka, Japan

[73] Assignee: Kabushiki Kaisha Kawaigakki Seisakusho, Shiz, Hamamatsu, Japan

[21] Appl. No.: 456,218

[22] Filed: Dec. 20, 1989

Related U.S. Application Data

[63] Continuation of Ser. No. 218,236, Jul. 12, 1988, abandoned.

[30] Foreign Application Priority Data

Aug. 13, 1987 [JP] Japan ..... 62-202171

[51] Int. Cl.[5] ..... G10H 1/08

[52] U.S. Cl. ..... 84/660; 84/625

[58] Field of Search ..... 84/608, 622–625, 84/648, 660, 675–677, 692–698

[56] References Cited

U.S. PATENT DOCUMENTS

| | | | |
|---|---|---|---|
| 4,256,003 | 3/1981 | Deutsch | 84/1.22 |
| 4,508,000 | 4/1985 | Suzuki | 84/1.01 |
| 4,709,611 | 12/1987 | Takagi et al. | 84/1.22 |

*Primary Examiner*—Stanley J. Witkowski

*Attorney, Agent, or Firm*—McGlew & Tuttle

[57] ABSTRACT

A digital electronic musical instrument for synthesizing a musical waveform by computing high harmonics. The musical instrument includes a musical waveform generator, an overflow detection circuit and a data selection circuit. A musical waveform is preferably added at an adder which outputs an added musical waveform. This output added musical waveform is checked to determine if an overflow condition occurs. A data selection circuit receives the added musical waveform and establishes level limited data and non level limited data. The data selection circuit selects the level limited data upon occurrence of an overflow condition and selects non level limited data when no overflow condition exists.

6 Claims, 5 Drawing Sheets

+

+

ELECTRONIC MUSICAL INSTRUMENT WITH DATA OVERFLOW DETECTOR AND LEVEL LIMITED DATA SELECTION CIRCUIT

This is a file wrapper continuation application of application Ser. No. 218,236 filed July 12, 1988 and now abandoned.

BACKGROUND OF THE INVENTION

1. Field of the Invention

The present invention relates to an electronic musical instrument which is capable of preventing an overflow in the addition of waveforms for creating a composite musical waveform.

2. Description of the Prior Art

In the case where two waveforms, such as shown in FIGS. 5A and 5B, are simply added together by conventional digital musical waveform generating means, such a distorted waveform as depicted in FIG. 5C may sometimes be provided.

This is caused by the disappearance of a carry bit to be included in the addition, due to an overflow, and the spectrum of the resulting waveform includes, in addition to spectral components of the waveforms shown in FIGS. 5A and 5B, a noise-like high-frequency component resulting from the deformation of the waveform by the overflow.

Sometimes the noise component is so large that the sound of the composite waveform is quite different from the sound of original waveforms, and the sound of a waveform in which an overflow is present as shown in FIG. 5C can no longer be called a musical sound but it is nothing less than a noise. To avoid the generation of such an overflow, it is necessary to lower the levels of the waveforms of FIGS. 5A and 5B before they are added together. Where the number of waveforms to be added together is large, their levels must be reduced in proportion to the number of waveforms involved. This will narrow the dynamic range of each of the waveforms to be added, resulting in the degradation of the quality of sound.

SUMMARY OF THE INVENTION

It is therefore an obJect of the present invention to prevent the reduction of the dynamic range of each of waveforms to be added together into a composite waveform and reform it so that no overflow will occur therein.

To attain the above obJect, the electronic musical instrument of the present invention is provided with musical waveform generating means for generating musical waveforms through computation, adding means for adding together the generated waveforms, and overflow preventing means which outputs a preset maximum value when detecting an overflow in the addition.

DESCRIPTION OF THE PREFERRED EMBODIMENTS

Figure 1A:
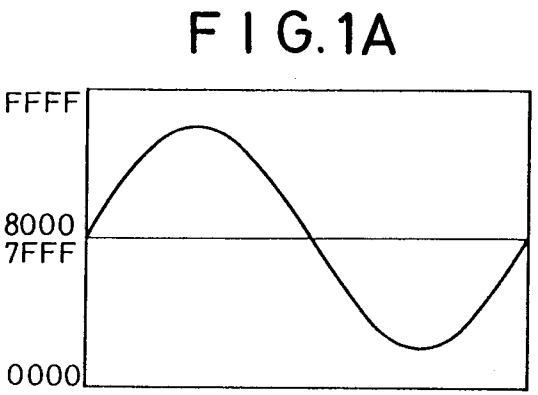
FIGS. 1A to 1C are diagrams explanatory of the principle of the present invention.
Figure 1B:
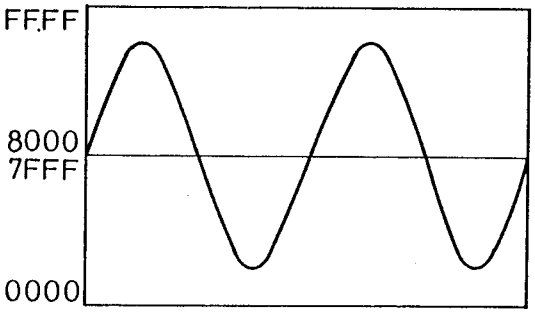
Figure 1C:
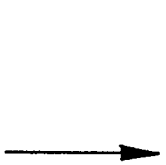
Figure 1C:
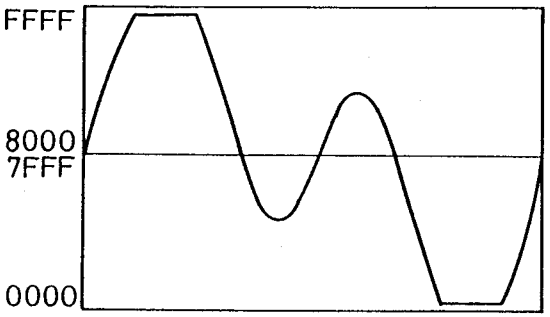
Figure 5A:
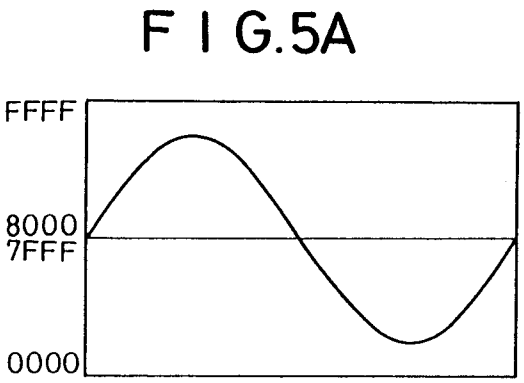
Figure 5B:
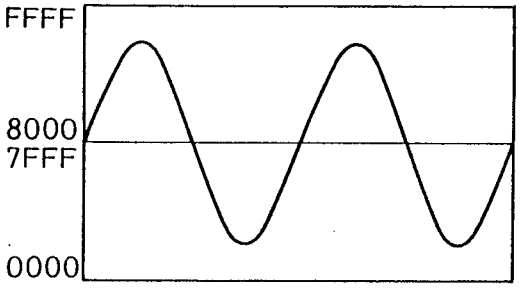
Figure 5C:
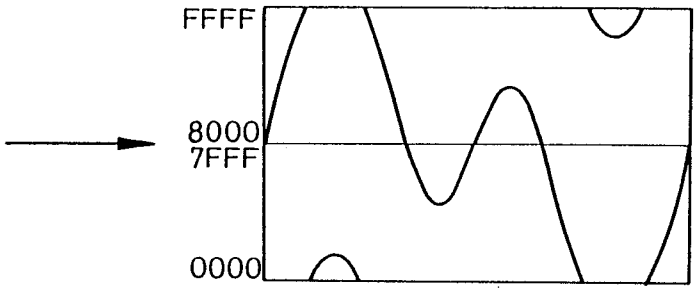

A description will be given first, with reference to FIGS. 1A to 1C, of the principle of the present invention. A composite waveform shown in FIG. 1C, into which waveforms depicted in FIGS. 1A and 1B are combined in the same manner as in the prior art described in respect of FIG. 5, is limited in level, by a limiter circuit, at a predetermined upper and/or lower limit of the level of the waveform. In this instance, since the level-limited portion forms sharp edges, some noise components are generated. However, the waveform thus obtained is far less distorted than the waveform distorted by an over-flow as shown in FIG. 5C and permits relatively faithful reproduction of the original sound. This affords a margin in sound reproduction. Furthermore, the limiter circuit is simple-structured, and accordingly a marked effect can be produced without incurring an appreciable increase in the manufacturing costs.

Figure 2:
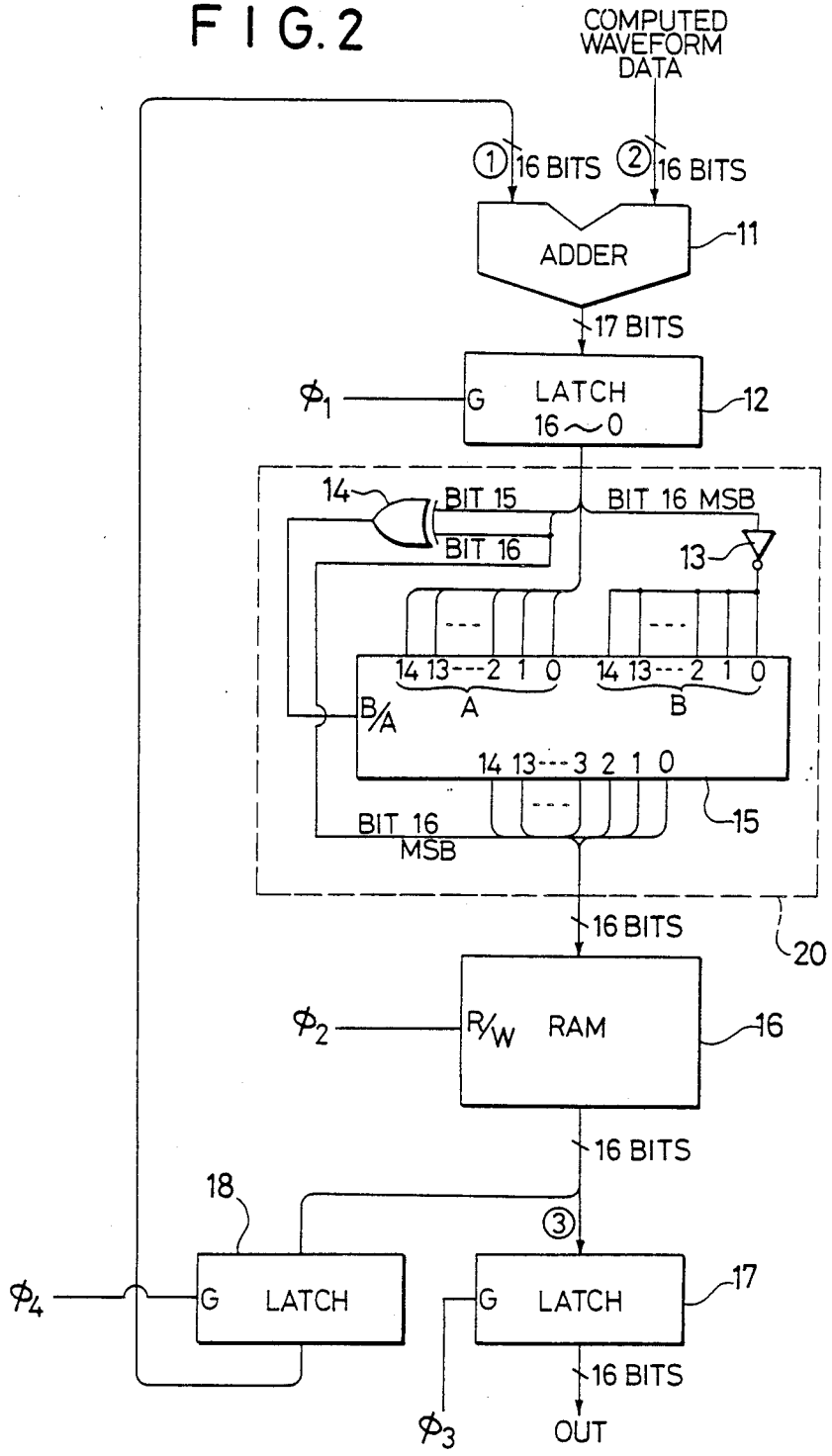
FIG. 2 is a block diagram illustrating the arrangement of an embodiment of the present invention.

FIG. 2 is explanatory of an embodiment of the present invention, illustrating the circuit arrangement of that portion of a waveform generator which is equipped with the limiter function and disposed near the output portion of the generator. Reference numeral 20 designates a limiter circuit, which is indicated by the broken line.

A waveform memory (RAM) 16 has a plurality of group memories of the same number as that of timbres involved and corresponding to them, respectively. The waveform memory 16 is capable of writing a plurality of waveforms into the group memories on a time-shared basis. The waveform data stored in each group memory is read out therefrom in response to a read/write signal $\phi_2$ and latched by a latch signal $\phi_4$ in a latch 18. An adder 11 is a 16 bit adder, which serves to add the waveform data latched in the latch 18 and waveform data computed by a waveform generator provided at a stage preceding the adder 11. The waveform data of each group is periodically written into and read out of the corresponding group memory of the RAM 16. The waveform data latch in the latch 18 is added, by the adder 11, to the waveform data of the same group applied thereto.

The waveform data thus added together is each group is provided, as 17-bit data, to a latch 12. The latch 12 is periodically refreshed by a signal $\phi_1$ and the waveform data of each group from the adder 11 is latched by the signal $\phi_1$ in the latch 12.

The output from the latch 12 is applied to the limiter circuit 20. An inverter 13 sets 15 bits 0 to 14 of the waveform data to all ones or zeros depending on whether the most significant bit of the data is a "0" or "1", and inputs the data into a side B input of a data selector 15 which has a side-A input as well. The side A input of the data selector 15 is supplied with non-level limited data and the side-B input is supplied with level-limited data.

Bits 16 and 15 of the waveform data are input into an exclusive-OR gate (EX-OR) 14. Since the waveform data is computed in two's-complement form, the output from the EX-OR 14 indicates whether "an overflow is occurring or not". When the output of the EX OR 14 is a "0", that is, when no overflow is occurring, the side A of the data selector 15 is selected and the waveform data from bit 0 to bit 14 is output intact. When the output from the EX-OR 14 is a "1", that is, when an overflow is occurring, the side B of the data selector 15 is selected and 15-bit data limited in waveform level at predetermined upper and lower limit values is output from the data selector 15. The bit 16 is provided as the sign bit MSB of the output data and the output data from the data selector 15 is written into the RAM 16 by the read/write pulse $\phi_2$. Waveform data read out of the RAM 16 at the readout timing of the pulse $\phi_2$ is latched by a latch pulse $\phi_3$ in a latch 17, whose output is provided to a D-A converter (not shown).

Simply by adding the conventional circuit arrangement with the circuit surrounded by the broken line as described above, the tone generator can be equipped with the limiter function and an excellent effect can be achieved.

Figures 4A, 4B:
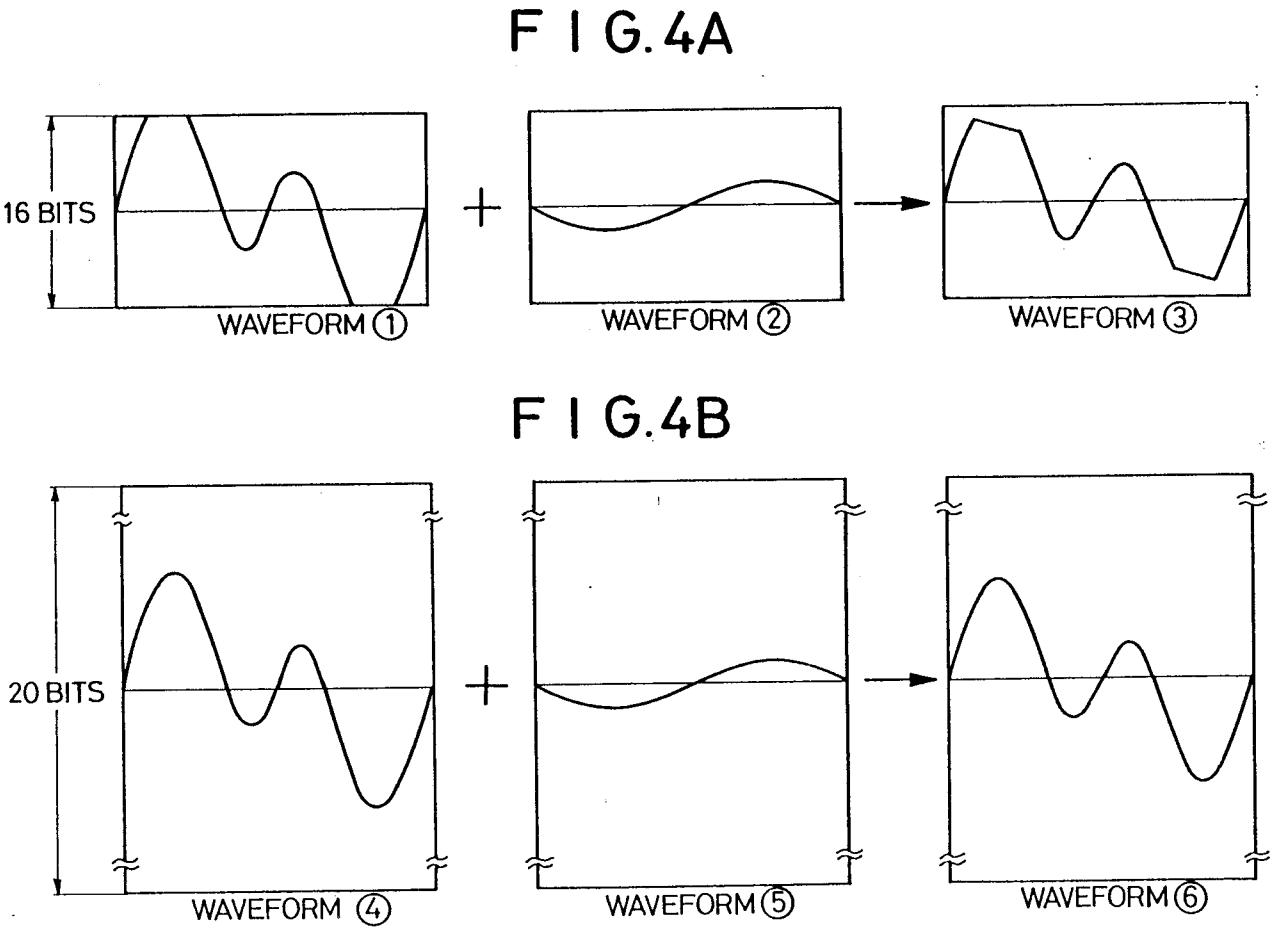
FIGS. 4A and 4B are diagrams explanatory of the operations of the embodiments shown in FIGS. 2 and 3, and FIGS. 5A to 5C are diagrams explanatory of a prior art example.

FIG. 4A is explanatory of the operation of the embodiment described above in respect of FIG. 2. In principle, in the case where a waveform (1) level limited in such a manner as shown in FIG. 1C is stored in the 16-bit RAM 16, feed back to the adder 11 and added therein to computed waveform data (2) and the added waveform is limited by the limiter circuit 20, a waveform (3) is obtained which has a margin in its dynamic range afforded by the addition of the waveforms. Accordingly, there is a room for enlarging the dynamic range of each waveform in this case. The present invention thus enables the dynamic range of each waveform to be increased effectively.

Figure 3:
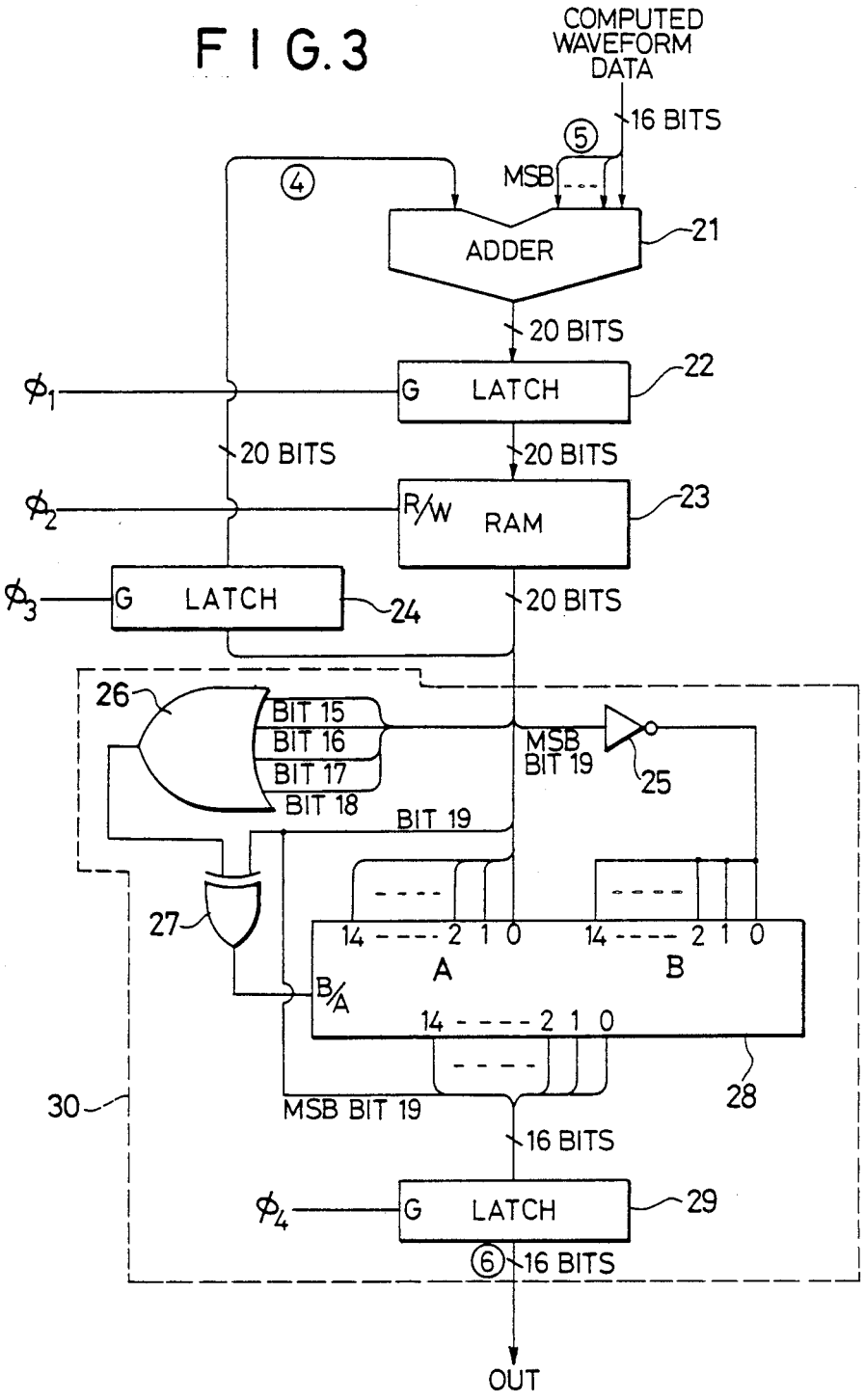
FIG. 3 is a block diagram illustrating another embodiment of the present invention.

FIG. 3 illustrates another embodiment of the present invention, which is intended to further enhance the limiter function of the circuit arrangement shown in FIG. 2.

Referring now to FIGS. 4A and 4B, the functions of the embodiments shown in FIGS. 2 and 3 will be compared using waveforms. FIG. 4A shows the process of adding together waveforms of each group in the embodiment described above in connection with FIG. 2.

In the embodiment shown in FIG. 2, the waveform (1) is an added waveform of each group which has already been amplitude limited by the limiter 20 and which is held in the latch 18. The waveform (2) is computed waveform data which is computed by the aforementioned waveform generator and provided to the adder 11. The waveform (3) is a waveform which is obtained by adding together the waveforms (1) and (20) by the adder 11.

The waveform which has once reached a level in excess of 16 bits as mentioned above has portions removed by the limiter 20. Even if this waveform is added to a waveform which would reduce the amplitude of the resulting or composite waveform (3), such as the waveform (2), the removed portions of the waveform (1) will not be restored in the composite waveform (3) and the waveform distortion will be rather increased. This waveform distortion is likely to be further increased when this cycle is repeated several times.

FIG. 4B shows the process of adding together waveforms in the embodiment depicted in FIG. 3. As will be described in detail later with regard to FIG. 3, a waveform (4) is an added waveform of each group which is held in a latch 24. The amplitude of this waveform is iu excess of 16 bits but this waveform retains its original form, because an internal RAM 23 and a data bus employed in this embodiment are 20-bit. A waveform (5) is computed waveform data by the waveform generator and provided to an adder 21. A waveform (6) is one that is obtained by adding the waveforms (4) and (5) in the adder 21.

The RAM 23 has four memories (which will hereinafter be referred to as group memories). Assuming, for example, that this tone generator has a 16-channel waveform generator and that information of one of the group memories has been provided to each channel, there is the possiblility of all the 16 channels being assigned to one group. In such an instance, even if 16 waveforms of 16 bits are added together, the resulting data length is 20 -bit at the longest; therefore, any portion of the waveform will not be lost by an overflow in the addition of waveforms.

The 20-bit waveform data thus obtained in each group and stored in the RAM 23 is provided to a limiter circuit 30, in which it is compacted from the 20-bit length to a 16-bit length, and then the compacted data is output for D-A conversion.

That is to say, during the addition in each group the added waveform retains its complete form and is subJected to the amplitude limitation for the first time immediately before it is output from this tone generator to the outside. This provides far greater precision than in the case where the amplitude limitation takes place for each addition in each series as in the embodiment shown in FIG. 2.

In the embodiment shown in FIG. 3, the waveform data memory (RAM) 23 is 20-bit, and even if waveforms on the 16 channels are centered on one of the groups, no overflow will occur in the adder 21 and the waveform data RAM 23, as seen from the waveforms (4) and (5) depicted in FIG. 4B, and the waveform data will ultimately be compacted to 16-bit data at the output stage, as seen from the waveform (6) in FIG. 4B. This function minimizes the waveform distortion.

Next, a description will be given of the circuit arrangement of the embodiment shown in FIG. 3. The adder 21 is a 20-bit adder, which adds together the computed waveform data and the series-added waveform data. A latch 22 latches the output from the adder 21 at the timing of the latch pulse $\phi_1$. The RAM 23 is a 20-bit waveform memory, whose read/write operation is performed by the read/write pulse $\phi_2$. A latch 24 latches, by the latch pulse $\phi_3$, the waveform data read out of the waveform data RAM 23. The waveform data latched in the latch 24 is looped back to the adder 21. An inverter 25 inverts the most significant bit 19 of the 20-bit data output from the RAM 23 and inputs bits 0 to 14 of the data into the side B input of a selector 28. In this case, the bits 15 to 18 are applied to a 4-input OR circuit 26 and the bit 19 is applied to an EX-OR circuit 27. A combination of the 4-input OR circuit 26 and the EX-OR circuit 27 the checks bits 15, 16, 17 and 18 of the 20-bit waveform data and yields a "1" or "0" depending on whether an overflow is occurring or not.

The selector 28 is controlled by the output from the EX-OR circuit 27 and selects the data on the side A (output bits 0 to 14 from the waveform data RAM 23) when no overflow is occurring, and the data on the side B (the output from the inverter 25) when an overflow is occurring. The output from the selector 28 is 15-bit but the bit 19 output from the latch 24 is added thereto, and consequently 16-bit data is provided to a latch 29. The latch 29 latches the output from the selector 28 by the latch pulse $\phi_4$ and provides it to the input of a D-A converter (not shown).

It is inevitable that the number of gates used in the circuit arrangement of this embodiment is somewhat larger than in the embodiment shown in FIG. 2. In the circuits 21, 22, 23 and 24 the waveform data is handled as 20-bit data, which is four bits longer than the 16-bit data handled in the embodiment depicted in FIG. 2. But such a small increase in the number of gates used can be ignored because it provides a complete limiter circuit. Even if the 16 channels are all assigned to one group, the ultimate waveform always makes full use of the 16-bit dynamic range and is scarcely distorted by the addition in each group, as seen from the waveform (3) in FIG. 4B. Thus this embodiment makes the limiter function more complete.

As described above, according to the present invention, when an overflow is detected in the waveform addition, the limiter function is applied, ensuring the production of a high quality musical waveform of extremely small distortion.

It will be apparent that many modifications and variations may be effected without departing from the scope of the novel concepts of the present invention.

What is claimed is:

1. A digital electronic musical instrument which synthesizes a musical waveform by computing, comprising:

musical waveform generating means for generating musical waveforms through computation;

adding means for adding together the musical waveforms generated by said musical waveform generating means; and limiter circuit means for receiving an added musical waveform from said adding means, detecting the existence of an overflow condition and delivering said added musical waveform if no overflow condition is detected and delivering a preset maximum value waveform signal when an overflow condition is detected.

2. A digital electronic musical instrument according to claim 1 wherein said added musical waveform is in the form of 20 bit data, said limiter circuit means receiving 20 bit data and outputting 16 bit data.

3. Digital electronic musical instrument which synthesizes a musical waveform by computing, comprising:

musical waveform generating means for generating waveforms through computation;

adding means for adding together the musical waveforms generated by the generating means to form an added musical waveform signal;

overflow detection circuit means for receiving a portion of an added musical waveform from said adding means and outputting an overflow signal when an overflow condition exists; and, data selection means for receiving said added musical waveform from said adding means and establishing level limited data, which is fixed at a certain amplitude level, and non-level limited data which is the same as said added musical waveform formed by said adding means, said data selection means being connected to said overflow detection circuit means, said data selection means receiving said overflow signal of said overflow detection circuit means and outputting said level limited data instead of said added musical waveform when an overflow condition has been detected and outputting said non-level limited data, which is the same as said added musical waveform when no overflow condition has been detected.

4. A digital electronic musical instrument according to claim 3 further comprising digital to analog conversion means for receiving data output by said data selection means and for outputting a corresponding analog signal.

5. A digital electronic musical instrument according to claim 3, further comprising level limited data formation means for receiving said added musical waveform from said adding means receiving said overflow signal from said overflow detection circuit means and for setting bits of said added musical waveform to all one's or all zero's in dependence upon whether a most significant bit of said added data signal is a zero or a one.

6. A device for combining musical waveforms represented digitally by instantaneous amplitude, the device comprising:

addition means for adding the instantaneous amplitudes of the digitally represented musical waveforms into a sum, said sum having extra digits to allow for increases of orders of magnitude;

detection means for detecting if an overflow condition has occurred in said sum, and for detecting if said overflow is one of a positive or negative overflow;

selection means for choosing and delivering said sum if no overflow exists, for choosing and delivering a maximum negative number if said negative overflow exists, and for choosing and delivering a maximum positive number if a positive overflow exists.

* * * * *